US006152295A

United States Patent [19]

Brander et al.

[11] Patent Number: 6,152,295

[45] **Date of Patent: *Nov. 28, 2000**

[54] STORAGE CONTAINER FOR CONTAINING FOOD PRODUCTS

[76] Inventors: William M. Brander, 280 Hallah Cir., Atlanta, Ga. 30328; Richard E. d'Ablaing, 225 LaGrange St., Newnan, Ga. 30263

[ * ] Notice: This patent issued on a continued prosecution application filed under 37 CFR 1.53(d), and is subject to the twenty year patent term provisions of 35 U.S.C. 154(a)(2).

[21] Appl. No.: 09/105,349

[22] Filed: Jun. 26, 1998

Related U.S. Application Data

[60] Provisional application No. 60/079,550, Mar. 27, 1998, and provisional application No. 60/086,854, May 27, 1998.

[51] Int. Cl.[7] ..... B65D 81/26; B65D 1/36

[52] U.S. Cl. ..... 206/204; 229/407; 426/124; 426/396

[58] Field of Search ..... 206/204, 557; 426/119, 120, 124, 129, 396; 229/406, 407

[56] References Cited

U.S. PATENT DOCUMENTS

| | | | |
|---|---|---|---|
| 3,026,209 | 3/1962 | Niblack et al. | 206/209 X |
| 3,040,947 | 6/1962 | Well et al. | 229/407 |
| 3,156,402 | 11/1964 | Dupuis . | |
| 3,580,413 | 5/1971 | Quackenbush | 426/129 X |
| 3,834,606 | 9/1974 | Andersson | 229/406 |
| 4,442,969 | 4/1984 | Holden . | |
| 4,552,600 | 11/1985 | Laiewski et al. . | |
| 4,576,278 | 3/1986 | Laiewski et al. . | |
| 4,702,377 | 10/1987 | Grone . | |
| 4,898,273 | 2/1990 | Kristiansen | 206/204 |
| 4,949,897 | 8/1990 | Pawiak et al. . | |
| 5,135,787 | 8/1992 | Bair . | |
| 5,176,930 | 1/1993 | Kannankeril et al. . | |
| 5,361,465 | 11/1994 | O'Donnell . | |
| 5,709,897 | 1/1998 | Pearlstein . | |
| 5,720,999 | 2/1998 | Lanzani et al. . | |

FOREIGN PATENT DOCUMENTS

| | | | |
|---|---|---|---|
| 2402599 | 5/1979 | France | 206/204 |
| 4039354 | 6/1992 | Germany | 206/204 |
| 4234632 | 4/1994 | Germany | 206/204 |
| 406080164 | 3/1994 | Japan | 206/204 |

*Primary Examiner*—Bryon P. Gehman
*Attorney, Agent, or Firm*—Thomas, Kayden, Horstemeyer & Risley

[57] ABSTRACT

A storage container (12) includes, in some embodiments, a tray insert (10) having a base (14) and side walls (16) which define a reservoir (18) for retaining fluids exuded from stored food. The base (14) of the tray insert (10) substantially conforms to the bottom of the storage container (12) into which the tray insert (10) is placed and the upper edge (28) of the side walls (16) substantially conforms to the interior side wall of the storage container (12). A series of ribs (20) and optional rib segments (25) extend upwardly from the base (14) of the tray insert (10), with the ribs (20 and 25) and the upper edge (28) of the side walls (16) supporting a cover (26) formed of liquid permeable sheet material so that the cover (26) supports food which has been placed into the storage container (12). A superabsorbent material (19) is placed into the reservoir (18) below the cover (26) so that fluids exuded from the stored food can pass through the cover (26) and are absorbed and retained by the superabsorbent material (19). In other embodiments, the tray insert (10) and ribs (20 and 25) can be formed directly into the base (14) of a container (12).

22 Claims, 4 Drawing Sheets

STORAGE CONTAINER FOR CONTAINING FOOD PRODUCTS

RELATED APPLICATIONS

This application is a utility application based on and claiming priority to U.S. Provisional Applications, Ser. Nos. 60/079,550, filed on Mar. 27, 1998, and 60/086,854, filed on May 27, 1998.

FIELD OF THE INVENTION

The present invention generally relates to storage containers for storing foods and other products that bear liquids which are likely to be exuded from the products. More particularly, the present invention relates to food storage containers incorporating a reservoir which contains absorbent material for collecting and absorbing excess liquids which exude from food, etc., in the form of biofluids, marinades, saline, juices, water, etc, so that the liquids and their associated microorganisms are separated from the food while contained in the storage containers.

DESCRIPTION OF THE PRIOR ART

Excess moisture within food storage containers can cause premature spoilage of food products which are stored in the containers because the moisture provides a favorable environment for the growth and reproduction of microorganisms. Excess moisture in a storage container also can lead to leakage of fluids from the storage container which can cause contamination of other foods and items about the container. Attempts at controlling excess moisture in food storage containers, such as trays (rigid and flexible) and bags, have met with some success. These prior art devices include: (1) pre-formed trays configured for the insertion of absorbent pads or absorbent sheets with the food products resting on the absorbent pad; (2) trays with built-in reservoirs arranged to trap excess moisture exuded from the products, with some of the trays including a cover which allows fluids to drain from the product into the reservoir but which partially restricts the fluids from reemerging past the cover following shaking or movement of the tray; and (3) trays or packs made from multiple layers of material with one layer being liquid impervious, the second layer being formed with perforations to allow fluids to enter, and an absorbent media sandwiched between the two layers to absorb and retain the entering fluids.

Several aspects of the prior art food containers with absorbent media limit the overall effectiveness of the containers and thereby fail to adequately address the need for absorbing excess liquids exuded from food products stored in containers. Particularly, a pad of absorbent material, typically formed of paper or a fluff-pulp structure, absorbs fluids but can not retain a great quantity of fluids when the pad is under pressure, such as when food is placed directly upon the pad or when food is placed on an upper layer of a tray which incorporates a pad sandwiched below the upper layer. In these configurations, the weight of the food upon the upper layer or directly on the absorbent pad compresses the pad and reduces the capacity of the pad to absorb liquids. Additionally, the amount of paper or fluff that would be required to produce a pad with sufficient absorbency to absorb and retain high levels of liquid is likely to require the pad to be too large for practical use. Furthermore, the prior art food storage trays usually have not incorporated reservoirs of a sufficient size to hold high levels of excess fluid without physically weakening the trays, thereby increasing the tendency of the trays to crack and leak fluids.

Therefore, it would be desirable to provide a device which accommodates the storage of food products that are likely to exude liquids and which is capable of storing excess fluids exuded from the food products.

SUMMARY OF THE INVENTION

Briefly stated, the present invention comprises a storage container for food or other products which tend to exude liquids or vapors and which is capable of absorbing and storing excess fluids exuded from the products. The storage container includes a support structure which, in some embodiments, is in the form of a tray insert which incorporates a reservoir that contains a quantity of super-absorbent particles. A sheet of liquid permeable material covers the reservoir and allows liquid to enter the reservoir but keeps the absorbent material from escaping from the reservoir. The tray and its absorbent particles are inserted into a larger storage container which can be disposable or adapted for reuse, and the tray rests on the bottom of the larger storage container. Typically, the storage container would be filled with food products, such as butchered meat, poultry, prepared produce, etc, which would rest upon the top of the absorbent tray insert, and the absorbent tray collects, absorbs and retains any fluids exuded from the stored products and which seep into the reservoir.

The tray insert has a fluid collection and retention area or reservoir for containing fluids which are leaked into the reservoir, as well as for containing the super-absorbent particles, which can include cellulose derivatives, polymeric substances, clays or other suitable substances possessing sufficient absorbent characteristics. The tray insert can incorporate raised ribs which can be arranged in numerous configurations including parallel, diverging and interlacing configurations, among others, depending upon the desired support characteristics required for a particular application. The ribs of the tray also serve as structural supports for the food products which are placed in the storage container above the absorbent tray insert and which rest on the insert. The ribs retain the products above the bottom of the storage container and above the reservoir at the bottom of the tray insert, thereby forming a space in which fluids can accumulate and mix with the absorbent particles and in which the expansion of the absorbent particles can occur without restriction.

The liquid permeable sheet is placed across the tray insert to cover the reservoir and is bonded to the upper periphery of the tray insert, such as by heat sealing, applying an adhesive or by other suitable means. In some embodiments, the sheet also can be bonded to the upper surfaces of the raised ribs for added structural support. The liquid permeable sheet forms an additional support surface for the stored products as the sheet spans the gaps formed between the raised ribs to form a "false bottom" support surface in the bottom of the storage container. Once products are placed upon the liquid permeable sheet, any fluids exuded from the products are able to flow through the sheet and into the reservoir where interaction with the super-absorbent particles causes the fluids to be substantially retained within the tray insert and away from the products. The liquid permeable sheet retains the absorbent particles beneath the false bottom before and after the fluid is absorbed by the absorbent particles with the particles taking up the fluid, in some embodiments, into a gel structure. In this manner, fluids exuded from the food products are substantially prevented from reentering the storage space of the storage container and contaminating the stored food, thereby potentially limiting the impact of food spoilage organisms. Additionally, since the absorbent material is contained below the false bottom the absorbent material is not compressed by the weight of the stored products, and therefore, is able to absorb and retain greater quantities of fluid as compared to the known prior art devices. After use, the tray insert can be easily removed from the storage container and conveniently disposed.

When the insert has been incorporated with a reusable storage container, once the insert has been removed, the storage container can then be cleaned and prepared for reuse by inserting a new tray insert and loading the container with food products. When the insert has been incorporated into a disposable storage container, the combination container and insert can be disposed without removing the insert.

The tray inserts can be formed of polystyrene, polypropylene, high density polyethylene, co-polyester or other similar materials, and can be thermally-formed, vacuum formed, etc., to produce a lightweight, shaped insert. In the preferred embodiment, the insert also conforms to the shape of the bottom portion of the container in which it is to be inserted. So configured, the container housing the insert provides strength and support to the insert so that the insert can adequately support the weight of the food products resting on the insert cover and the weight of the fluid laden absorbent material residing within the insert reservoir. Likewise, the upper edge of the tray insert substantially conforms to the interior side walls of the storage container to provide added strength to the tray insert and so that fluids are substantially prevented from seeping between the insert and the storage container.

Additionally, the ribs provide structural support to the tray insert such that the insert can be formed to quite a large size without the disadvantages of the prior art devices which are size limited due to a lack of incorporated structural support components. These ribs also provide the benefit of preventing migration of the absorbent material between the ribs, thereby substantially retaining the absorbent material in a uniform distribution throughout the tray insert. Furthermore, rib segments also can be incorporated into the insert which run normal to the main ribs, or in an orientation other than the orientation of the main ribs, thereby adding more support to the structure of the insert and further limiting migration of the absorbent material within the reservoir.

In some embodiments, the tray insert also can incorporate fluid inlets or holes about the bottom and side walls of the tray insert to allow fluids which seep between the insert and the storage container to enter the insert and be absorbed by the absorbent material within the insert reservoir. The addition of the fluid inlets also reduces the necessity for a seal to be formed between the upper edge of the tray insert and the side walls of the container and provides an added means of fluid absorption when the seal existing between the insert and the storage container is disturbed, such as when the storage container or the tray is slightly deformed or damaged during shipping.

The insert cover which spans the reservoir is preferably made of material such as perforated film, apertured film, non-woven fabric, non-woven fabric laminated to apertured film, multi-composites or other suitable pervious material that can be bonded to the insert to create a liquid-pervious barrier between the food product placed on the cover of the insert and the reservoir within the insert.

In some embodiments, the tray insert can be integrated with a disposable container to form a unitary structure. In this disposable-container configuration, the container is adapted for one-time use, and then the entire insert and container combination is discarded. In other disposable-container embodiments, the tray insert mates with a container, such as by forcing the insert into the bottom of the container until the upper edge of the insert passes a flange which is formed about the interior side wall of the container.

In other embodiments, a disposable container can be formed which incorporates structural ribs similar to those found in a tray insert described hereinabove, with the ribs being formed as a part of the base of the container. Areas or cells formed between the ribs are then filled with absorbent material and a sheet of liquid permeable material is placed across the top of the ribs and sealed to the ribs so that a barrier or "false bottom" is formed for containing the absorbent material within the cells. The ribs can be formed in multiple configurations so that they structurally support the container, support the liquid permeable sheet and products placed thereon, and divide the reservoir so that the absorbent material is distributed throughout the reservoir as desired, i.e. uniformly, concentrated in the center, etc.

Therefore, it is an object of the present invention to provide an improved apparatus which is capable of storing excess fluids exuded from food products.

It is another object of the present invention to provide an improved tray insert for insertion in a storage container and which is capable of storing excess fluids exuded from food products stored in the container.

It is another object of the present invention to provide an improved tray insert for insertion in a storage container and which can absorb and retain substantially all the fluid exuded from the food products stored in a container without the food products contacting the retained fluid, and thereby increasing the shelf-life of the food products contained in the storage container.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present inventions, and together with the description serve to explain the principles of the inventions. The components in the drawings are not necessarily to scale, emphasis instead being placed upon clearly illustrating principles of the present inventions.

DETAILED DESCRIPTION OF THE PREFERRED EMBODIMENTS

Figure 1:
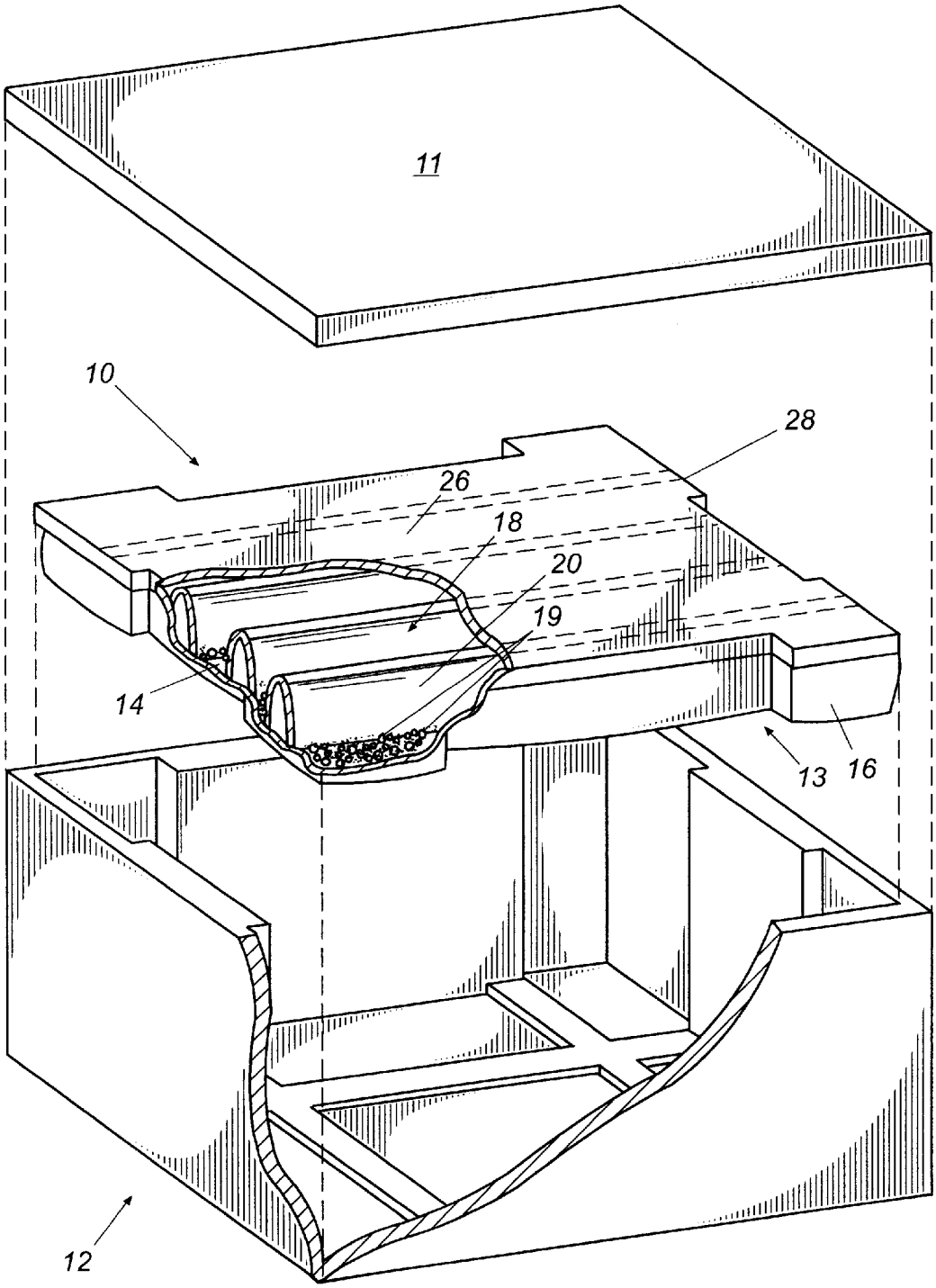
FIG. 1 is a partially cut-away, exploded perspective view of a preferred embodiment of the present invention incorporated into a representative storage container.

Referring now to the figures, wherein like reference numerals designate like parts throughout the several views, FIG. 1 depicts a preferred embodiment of the tray insert 10 of the present invention which is adapted to rest on the bottom of and conform to the interior of a storage container 12. The container 12 incorporates a lid 11 for sealing the container, however, it should be noted that the tray insert 10 is well suited for use in containers which do not incorporate lids, such as containers which are sealed by protective wraps and foils.

The tray insert 10 incorporates a tray portion 13 having a base 14 and side walls 16 which define a fluid collection and retention area or reservoir 18 for containing fluids which are leaked into the reservoir 18. The reservoir 18 also contains a quantity of super-absorbent material 19 which can take on various forms, such as particles, sheets, etc., with the material formed of cellulose derivatives, polymeric substances, clays or other suitable substances possessing sufficient absorbent characteristics.

The tray portion 13 can be formed of polystyrene, polypropylene, high density polyethylene, co-polyester or other similar materials, and can be thermally-formed, vacuum formed, etc., to produce a lightweight, shaped insert. In the preferred embodiment (FIG. 1), the tray insert 10 substantially conforms to the shape of the bottom portion of the interior of the storage container 12 in which the insert 10 is to be inserted. So configured, the storage container 12 housing the insert 10 provides strength and support to the insert 10 so that the insert 10 can adequately support the weight of the food products resting on the insert 10 and the weight of the fluid laden absorbent material 19 residing within the reservoir 18.

Figure 2:
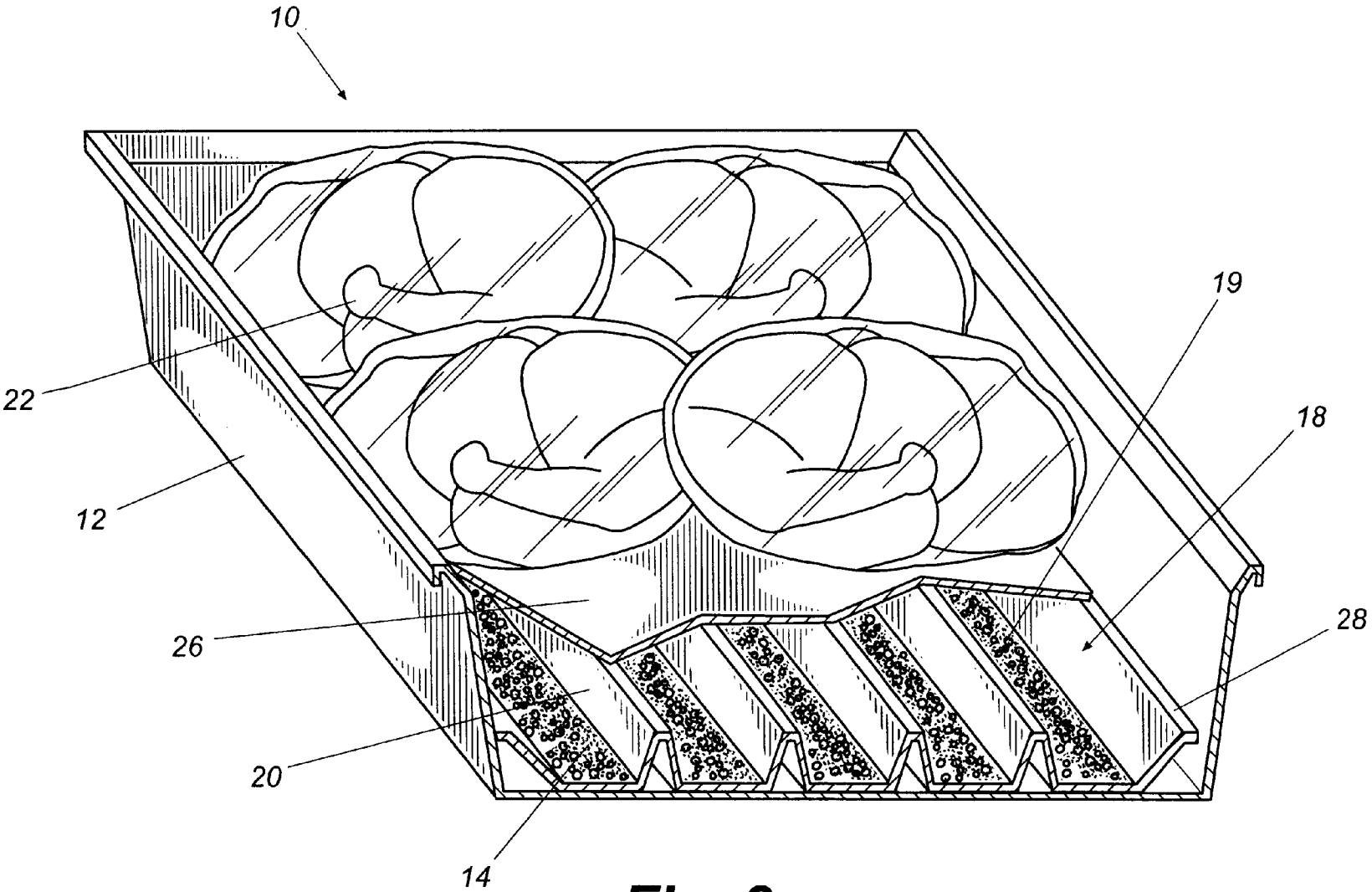
FIG. 2 is a partially cut-away perspective view of another embodiment of the present invention mounted within a storage container with representative food products placed upon the cover of the tray insert.

As shown in FIG. 1, the tray insert 10 incorporates one or more ribs 20 protruding from the base 14, and can be arranged in numerous configurations including parallel, diverging and interlacing, among others, depending upon the desired support characteristics required for a particular application. The ribs 20 serve as structural supports for food products 22 (shown in FIG. 2 as eviscerated poultry carcasses) which are placed in the storage container 12 above the absorbent tray insert 10 and which rest on the insert. The ribs 20 retain the products 22 above the bottom of the storage container 12 and the base 14 of the tray insert 10, thereby forming a space in which fluids (not shown) can accumulate and mix with the absorbent material 19 and in which expansion of the absorbent material 19 can occur without restriction.

Additionally, the ribs 20 provide structural support to the tray insert 10 such that the insert can be formed to quite a large size without the disadvantages of the prior art devices which are size limited due to a lack of incorporated structural support components. The ribs 20 also provide the benefit of preventing migration of the absorbent material 19 between the ribs 20, thereby substantially retaining the absorbent material 19 in a uniform distribution throughout the tray insert 10. Furthermore, rib segments (not shown in FIG. 1) also can be incorporated into the tray portion 13 which run normal to the main ribs 20, or in an orientation other than the orientation of the main ribs 20, thereby adding more support to the structure of the insert 10 and further limiting migration of the absorbent material 19 within the reservoir 18.

In the preferred embodiment of FIG. 1, a cover 26 formed of a liquid permeable sheet, is placed across the tray insert 10 to cover the reservoir 18. The cover 26 is preferably made of material such as perforated film, apertured film, non-woven fabric, non-woven laminated to apertured film, multi-composites or other suitable pervious material that can be bonded to the upper edge 28, for example, of insert 10, such as by heat sealing, applying an adhesive or by other suitable means, to create a barrier between the food products 22 placed on the cover 26 and the reservoir 18. In some embodiments, the cover 26 also can be bonded to the upper surfaces of the ribs 20 and rib segments for added structural support. As such, the cover 26 forms an additional support surface for the stored products 22 as the cover 26 spans the gaps formed between the raised ribs 20 to form a false bottom support surface in the bottom of the storage container 12. Therefore, the absorbent material 19 within the reservoir 18 and below the cover 26 is not compressed by the weight of the food products 22 placed on the cover 26, thereby allowing the absorbent material 19 to absorb and retain greater quantities of exuded fluid as compared to prior art devices Once products are placed upon the liquid permeable cover 26, any fluids exuded from the products 22 are able to flow through the cover 26 and into the reservoir 18 where interaction with the absorbent material 19 causes the fluids to be substantially retained within the tray insert 10 and away from the products 22. The cover 26 substantially retains the absorbent material 19 in the false bottom both before and after the fluid is absorbed by the absorbent material, thus preventing the fluid from recontaminating the stored food 22. After use, the tray insert 10 can be easily removed from the storage container 12 and conveniently disposed.

Additionally, in some embodiments, the tray insert 10 also can incorporate holes or fluid inlets (not shown) about the base 14 and side walls 16 of the tray portion 13 to allow fluids which seep between the insert 10 and the storage container 12 to enter the insert 10 and be absorbed by the absorbent material 19 within the reservoir 18. The addition of the fluid inlets also reduces the necessity for a seal to be formed between the upper edge 28 of the tray insert 10 and the interior side walls of the container 12 and provides an added means of fluid absorption when the seal existing between the insert 10 and the storage container 12 is disturbed, such as when the storage container 12 is slightly deformed or damaged during shipping. It should be noted, however, that the size and arrangement of the fluid inlets should be such that the absorbent material 19 is substantially retained within the reservoir 18.

Figure 3:
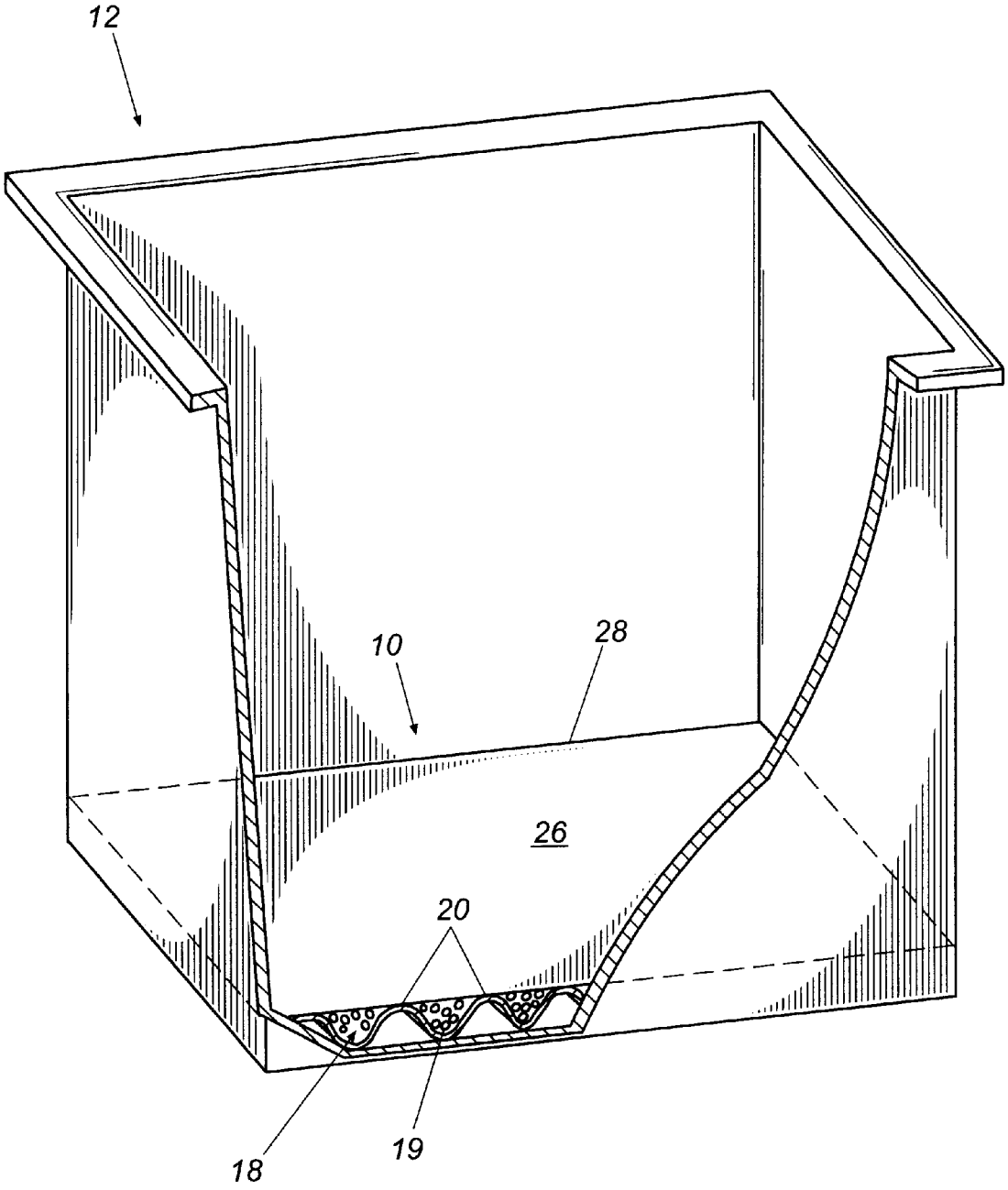
FIG. 3 is a partially cut-away, perspective view of an alternative embodiment of the present invention.

In some embodiments, the tray insert 10 can be integrated with a disposable storage container 12 to form a unitary structure as shown in FIG. 3. In this disposable-container configuration, the container 12 is adapted for one-time use, after which the entire insert-container combination is discarded. In other disposable-container embodiments (not shown), the tray insert 10 mates with a container 12, such as by forcing the insert 10 into the bottom of the container 12 until the upper edge 28 of the insert 10 passes a rib, flange or other protruding structure or structures (not shown), which are formed on the interior of the side wall of the container 12, thereby locking the insert 10 in place between the protruding structures and the bottom of the container 12.

When an insert 10 has been incorporated into a reusable storage container 12, i.e. FIG. 1, and the container has been used for transporting and/or storing food products, and the food products have been removed from the container for use, the insert 10 can then be removed and discarded. The storage container 12 can then be cleaned and reused by inserting a new tray insert 10 within the container and reloading the container with food products 22. Likewise, when the insert 10 has been incorporated into a disposable storage container 12, i.e. FIG. 3, and the container has been used for transporting and/or storing food products, and the food products have been removed from the container for use, the combination container and insert can be discarded without removing the insert 10.

In other embodiments (FIG. 4), a disposable storage container 12 can be formed which incorporates structural ribs 20 and rib segments 25 similar to those found in a tray insert 10 described hereinabove, with the ribs 20 and 25 being formed as a part of the base 14 of the container. A perimeter rib 29 also can be incorporated which extends inwardly from the side wall 16 and into the reservoir 18 and which can cooperate with the ribs 20 and 25 to form a series of cells 30. The cells 30 formed between the ribs 20, 25 and 29 are then filled with absorbent material 19. A cover 26 is placed across the top of the ribs and sealed to the ribs, and also, in some embodiments, to the side wall 16, so that a barrier is formed for containing the absorbent material 19 within the cells 30.

The ribs 20, optional rib segments 25 and optional perimeter rib 29 can be formed in multiple configurations so that they structurally support the container 12, support the liquid permeable cover 26 and products 22 placed thereon, and divide the reservoir 18 so that the absorbent material 19 is distributed throughout the reservoir as desired, i.e. uniformly, concentrated in the center, etc.

Figure 4:
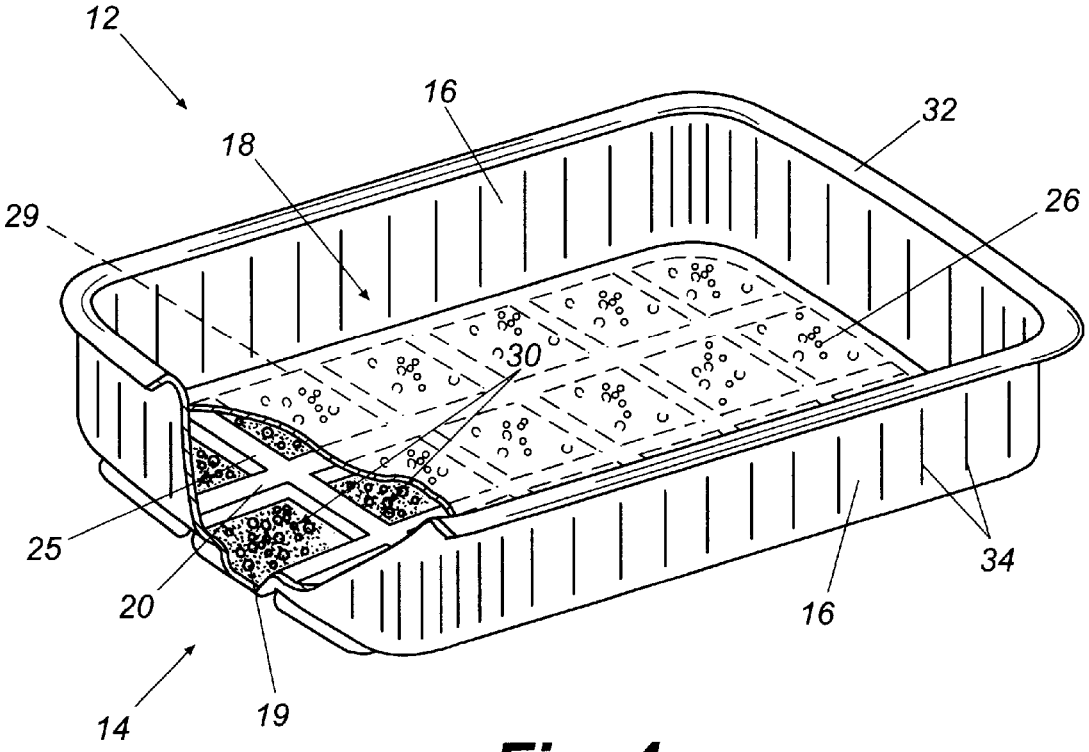
FIG. 4 is a partially cut-away, perspective view of an alternative embodiment of the present invention.

As shown in FIG. 4, an upper rim or flange can extend from the upper edge of the side wall 16 to provide a surface upon which a lid or covering (not shown) can be attached. The side wall 16 also can incorporate a series of vertical ribs 34 which reinforce the side wall 16 and provide a textured surface for ease of grasping the container 12.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

We claim:

1. A storage container for containing food products comprising:

a tray having a tray base and tray side walls, said tray side walls extending upwardly from a periphery of said tray base and forming an upper edge of said tray, said tray base and said tray side walls defining a reservoir;

an absorbent material arranged in said reservoir;

a cover attached to said tray adjacent to and in overlying relationship with said reservoir and spaced from said absorbent material, said cover formed of liquid permeable sheet material and engaging said tray, said cover forming a barrier for retaining said absorbent material within said reservoir and a substantially flat support surface for supporting food products placed upon said cover such that when food products are placed upon said cover, said cover remains spaced from said absorbent material; and a container having a container bottom and container side walls extending upwardly from a periphery of said container bottom and forming an upper edge of said container, said container bottom and said container side walls defining a container interior, said tray being sized and shaped for inserting within said container interior in an inserted position such that in said inserted position at least a portion of said tray base engages at least a portion of said container bottom, said upper edge of said tray substantially conforms to said container side walls, and said cover is oriented between said tray base and said upper edge of said container.

2. The storage container of claim 1, wherein said absorbent material comprises superabsorbent particles.

3. The storage container of claim 1, wherein said tray has at least one rib extending upwardly from said tray base, said at least one rib engaging said cover such that said at least one rib divides said reservoir into cells, said cells containing said absorbent material.

4. The storage container of claim 1, wherein said cover is attached to said tray side walls only at said upper edge of said tray said upper edge of said tray being oriented beneath said substantially flat support surface and being configured to support a peripheral edge of said substantially flat support surface.

5. The storage container of claim 1, wherein said cover is formed of a non-woven thermoplastic fabric.

6. The storage container of claim 5, wherein said container has a lid moveable between an engaged position and a disengaged position, when in said engaged position, said lid and said container encasing said tray within said container interior, and when in said disengaged position, said container providing access to said container interior.

7. The storage container of claim 1, wherein said tray has a plurality of ribs extending upwardly from said tray base and engaging said cover such that said plurality of ribs divide said reservoir into cells, said cells containing said absorbent material.

8. The storage container of claim 1, wherein said tray base has at least one fluid inlet extending therethrough and communicating with said reservoir, said at least one fluid inlet configured such that said absorbent material is substantially retained within said reservoir and fluids exuded from a food product placed within said storage container can enter said reservoir via said at least one fluid inlet.

9. The storage container of claim 1, wherein a food product is inserted into said storage container and sealed therein by applying to said storage container at least one of the group consisting of a lid, a protective wrap and a protective foil.

10. A storage container for containing food products comprising:

a container having a container bottom and container side walls, said container side walls extending upwardly from a periphery of said container bottom, said container bottom and said container side walls defining a container interior;

a tray configured for inserting within said container interior in an inserted position, said tray having an upper edge configured for substantially conforming to said container side walls when in said inserted position, said tray defining a reservoir;

an absorbent material arranged in said reservoir; and a cover for supporting food products placed within said container interior and for retaining said absorbent material within said reservoir, said cover formed of liquid permeable material and engaging said tray such that said cover forms a substantially flat support surface for supporting food products placed within said container interior, said cover being spaced from said absorbent material such that said absorbent material is arranged to absorb fluids exuded from food products placed within said container interior without the food products compressing said absorbent material.

11. The storage container of claim 10, wherein said tray has a tray base and tray side walls, said tray base being configured to substantially conform to said container bottom when in said inserted position, said tray having at least one fluid inlet extending therethrough and communicating with said reservoir, said at least one fluid inlet configured such that said absorbent material is substantially retained within said reservoir and fluids exuded from a food product placed within said container interior can enter said reservoir via said at least one fluid inlet.

12. The storage container of claim 10, wherein said tray has a tray base and at least one rib extending upwardly from said tray base such that said at least one rib divides said reservoir into cells and wherein said cells contain said absorbent material.

13. The storage container of claim 10, wherein said cover is attached to said tray only at said upper edge of said tray, said cover being formed of a non-woven thermoplastic fabric.

14. The storage container of claim 10, wherein said container has a lid moveable between an engaged position and a disengaged position, when in said engaged position, said lid and said container encasing said tray within said container interior, and when in said disengaged position, said container providing access to said container interior.

15. The storage container of claim 10, wherein a food product is inserted into said storage container and sealed therein by applying to said storage container at least one of the group consisting of a lid, a protective wrap and a protective foil.

16. A storage container for containing food products comprising:

a base;

a continuous side wall extending upwardly from a periphery of said base, said base and said continuous side wall defining a reservoir, said base having at least one main rib extending into said reservoir spanning substantially a length of said base such that said reservoir is divided into a plurality of cells, said continuous side wall having a perimeter rib extending about said continuous side wall and into said reservoir, said perimeter rib having an upper surface spaced at an approximately uniform distance from said base;

an absorbent material arranged in at least one of said plurality of cells; and a cover formed of liquid permeable material, a periphery of said cover engaging said upper surface of said perimeter rib and said at least one main rib, said cover forming a support surface for supporting food products placed within said storage container such that when food products are placed upon said cover, said cover remains spaced from said absorbent material.

17. The storage container of claim 16, wherein said cover is formed from a liquid permeable sheet material.

18. The storage container of claim 16, wherein said base has at least one rib segment extending therefrom, said at least one rib segment spanning between said continuous side wall and said at least one main rib, said at least one rib segment being oriented approximately normal to said at least one main rib.

19. The storage container of claim 18, wherein said at least one rib segment engages said perimeter rib.

20. The storage container of claim 19, wherein said cover engages said at least one rib segment.

21. The storage container of claim 16, wherein a food product is inserted into said storage container and sealed therein by applying to said storage container at least one of the group consisting of a lid, a protective wrap and a protective foil.

22. The storage container of claim 16, wherein said cover is formed of a non-woven thermoplastic fabric.

* * * * *